US006311776B1

(12) United States Patent
Pringle et al.

(10) Patent No.: US 6,311,776 B1
(45) Date of Patent: Nov. 6, 2001

(54) DUAL DIVERTER AND ORIENTATION DEVICE FOR MULTILATERAL COMPLETIONS AND METHOD

(75) Inventors: Ronald E. Pringle, Houston; Clay W. Milligan, Jr., Missouri City; Robert J. Coon, Houston, all of TX (US)

(73) Assignee: Camco International Inc., Houston, TX (US)

( * ) Notice: Subject to any disclaimer, the term of this patent is extended or adjusted under 35 U.S.C. 154(b) by 0 days.

(21) Appl. No.: 09/552,493

(22) Filed: Apr. 19, 2000

Related U.S. Application Data

(60) Provisional application No. 60/129,950, filed on Apr. 19, 1999.

(51) Int. Cl.[7] ..... E21B 7/06; E21B 43/14
(52) U.S. Cl. ..... 166/313; 166/50; 166/117.6
(58) Field of Search ..... 166/313, 50, 117.6

(56) References Cited

U.S. PATENT DOCUMENTS

| | | | |
|---|---|---|---|
| 1,900,163 | | 3/1933 | Dana . |
| 2,492,079 | | 12/1949 | Wiley . |
| 2,804,926 | | 9/1957 | Zublin . |
| 3,330,349 | | 7/1967 | Owsley et al. . |
| 4,396,075 | | 8/1983 | Wood et al. . |
| 4,415,205 | | 11/1983 | Rehm et al. . |
| 4,444,276 | | 4/1984 | Peterson, Jr. . |
| 4,807,704 | | 2/1989 | Hsu et al. . |
| 5,311,936 | | 5/1994 | McNair et al. . |
| 5,318,121 | | 6/1994 | Brockman et al. . |
| 5,325,924 | | 7/1994 | Bangert et al. . |
| 5,330,007 | | 7/1994 | Collins et al. . |
| 5,411,082 | | 5/1995 | Kennedy . |
| 5,427,177 | | 6/1995 | Jordan, Jr. et al. . |
| 5,454,430 | | 10/1995 | Kennedy et al. . |
| 5,462,120 | | 10/1995 | Gondouin . |
| 5,474,131 | | 12/1995 | Jordan, Jr. et al. . |
| 5,526,880 | | 6/1996 | Jordan, Jr. et al. . |
| 5,533,573 | | 7/1996 | Jordan, Jr. et al. . |
| 5,564,503 | | 10/1996 | Longbottom et al. . |
| 5,685,373 | | 11/1997 | Collins et al. . |
| 5,762,149 | | 6/1998 | Donovan et al. . |
| 5,785,133 | | 7/1998 | Murray et al. . |
| 5,845,707 | | 12/1998 | Longbottom . |
| 5,871,046 | * | 2/1999 | Robison ..... 166/242.1 |
| 5,878,815 | | 3/1999 | Collins . |
| 5,884,704 | | 3/1999 | Longbottom et al. . |
| 5,918,669 | | 7/1999 | Morris et al. . |
| 5,944,109 | | 8/1999 | Longbottom . |
| 5,960,874 | | 10/1999 | Morris et al. . |
| 6,009,942 | | 1/2000 | Williamson . |
| 6,089,320 | * | 7/2000 | LaGrange ..... 166/313 |
| 6,125,937 | * | 10/2000 | Longbottom et al. ..... 166/313 |
| 6,158,513 | * | 12/2000 | Nistor et al. ..... 166/313 |

* cited by examiner

*Primary Examiner*—Hoang Dang
(74) *Attorney, Agent, or Firm*—Goldstein & Polasek, LLP

(57) ABSTRACT

In a broad aspect, the invention is a downhole well tool for use within a well casing having a locking slot, an orienting profile, an alignment slot, and a lateral well bore window. The tool may broadly include a body member having a first and a second longitudinal bore extending therethrough, a diverter member extending therefrom and having a diverter surface. The second longitudinal bore extends through the diverter member. The tool may also include an outwardly-biased orienting key movably secured to the body member and engageable with the orienting profile and the alignment slot, and an outwardly-biased locking key movably secured to the body member and engageable with the locking slot. The diverter surface is aligned with the lateral well bore window when the orienting key is engaged with the alignment slot and the locking key is engaged with the locking slot. The tool also includes a first production tubing extending through the first longitudinal bore and aligned with the diverter surface, and a second production tubing extending through the second longitudinal bore. One of the first and second production tubings is releasably secured to the body member.

26 Claims, 11 Drawing Sheets

DUAL DIVERTER AND ORIENTATION DEVICE FOR MULTILATERAL COMPLETIONS AND METHOD

RELATED APPLICATIONS

This application claims the benefit of U.S. Provisional Application No. 60/129,950, filed Apr. 19, 1999.

BACKGROUND OF THE INVENTION

1. Field of the Invention

The present invention relates to subsurface well equipment and, more particularly, to an apparatus and method for simultaneously setting two production tubings in a well having at least one lateral well bore.

2. Description of the Related Art

To make production of hydrocarbons more economical, it has become commonplace for oil and gas companies to drill and complete one or more lateral, or branch, well bores, each extending from a main wellbore running to the earth's surface. After the main and lateral well bores have been drilled, the standard prevailing practice is to complete the lateral and main wells separately. This requires separate trips into the well to set the necessary tools and production tubing, each trip resulting in significant costs in time and money. The present invention has been developed to reduce these costs. As will be explained below, in broad terms, the present invention achieves this objective by doing in one trip what heretofore has been done in two.

SUMMARY OF THE INVENTION

In a broad aspect, the invention is a downhole well tool for use within a well casing having a locking slot, an orienting profile, an alignment slot, and a lateral well bore window, the tool comprising: a body member having a first and a second longitudinal bore extending therethrough, a diverter member extending therefrom and having a diverter surface, the second longitudinal bore extending through the diverter member; an outwardly-biased orienting key movably secured to the body member and engageable with the orienting profile and the alignment slot; an outwardly-biased locking key movably secured to the body member and engageable with the locking slot, the diverter surface being aligned with the lateral well bore window when the orienting key is engaged with the alignment slot and the locking key is engaged with the locking slot; a first production tubing extending through the first longitudinal bore and aligned with the diverter surface; and a second production tubing extending through the second longitudinal bore, one of the first and second production tubings being releasably secured to the body member. Another feature of this aspect of the invention is that the second production tubing is releasably secured to the diverter member. Another feature of this aspect of the invention is that a lower end of the diverter member is cone-shaped. Another feature of this aspect of the invention is that the orienting and locking keys are outwardly biased by at least one spring. Another feature of this aspect of the invention is that the orienting key is disposed for radial movement within a first recess in the body member. Another feature of this aspect of the invention is that the locking key is disposed for movement within a second recess in the body member. Another feature of this aspect of the invention is that the locking key is hingedly attached to the body member. Another feature of this aspect of the invention is that the locking key is shearably disconnectable from the body member. Another feature of this aspect of the invention is that the body member includes a locking profile remotely engageable with a well tool for disengaging the well tool from the casing. Another feature of this aspect of the invention is that the diverter member extends upwardly from the body member, and the locking slot, orienting profile and alignment slot are disposed in the well casing below the lateral well bore window. Another feature of this aspect of the invention is that the diverter member extends downwardly from the body member, and the locking slot, orienting profile and alignment slot are disposed in the well casing above the lateral well bore window.

In another aspect, the invention may be a downhole well tool for use within a well casing having a lateral well bore window, the tool comprising: a discriminator connected within the well casing and having a locking slot, an orienting profile, and an alignment slot; a body member having a first and a second longitudinal bore extending therethrough, a diverter member extending therefrom and having a diverter surface, the second longitudinal bore extending through the diverter member; an outwardly-biased orienting key movably secured to the body member and engageable with the orienting profile and the alignment slot; an outwardly-biased locking key movably secured to the body member and engageable with the locking slot, the diverter surface being aligned with the lateral well bore window when the orienting key is engaged with the alignment slot and the locking key is engaged with the locking slot; a first production tubing extending through the first longitudinal bore and aligned with the diverter surface; and a second production tubing extending through the second longitudinal bore, one of the first and second production tubings being releasably secured to the body member. Another feature of this aspect of the invention is that the second production tubing is releasably secured to the diverter member. Another feature of this aspect of the invention is that a lower end of the diverter member is cone-shaped. Another feature of this aspect of the invention is that the orienting and locking keys are outwardly biased by at least one spring. Another feature of this aspect of the invention is that the orienting key is disposed for radial movement within a first recess in the body member. Another feature of this aspect of the invention is that the locking key is disposed for movement within a second recess in the body member. Another feature of this aspect of the invention is that the locking key is hingedly attached to the body member. Another feature of this aspect of the invention is that the locking key is shearably disconnectable from the body member. Another feature of this aspect of the invention is that the body member includes a locking profile remotely engageable with a well tool for disengaging the well tool from the casing. Another feature of this aspect of the invention is that the diverter member extends upwardly from the body member, and the discriminator is connected to the well casing below the lateral well bore window. Another feature of this aspect of the invention is that the diverter member extends downwardly from the body member, and the discriminator is connected to the well casing above the lateral well bore window.

In another aspect, the present invention may be a downhole well tool for use within a well casing having a lateral well bore window, the tool comprising: a body member having a first and a second longitudinal bore extending therethrough; a first production tubing extending through the first longitudinal bore; a second production tubing extending through the second longitudinal bore, the first and second production tubings being coupled together so as to restrict relative longitudinal movement therebetween, one of the first and second production tubings being releasably secured to the body member; means for diverting the first production tubing through the lateral well bore window; and means for aligning the diverting means with the lateral well bore window.

In still another aspect, the present invention may be a method of completing a well having a main well bore and at least one lateral well bore, the method comprising: positioning a completion assembly in the main well bore, the completion assembly comprising at least a first and a second production tubing and a tubing diverter; simultaneously lowering the first and second production tubings, guided by the tubing diverter, the first production tubing being lowered into the at least one lateral well bore, and the second production tubing being lowered into one of the main well bore and another lateral well bore.

In another aspect, the present invention may be a method of completing a well having a main well bore and at least one lateral well bore, the method comprising: setting a first packer in the at least one lateral well bore, the first packer having a polished bore receptacle extending therefrom and being adapted to receive a first production tubing; setting a second packer in one of the main well bore and another lateral well bore, the second packer having a polished bore receptacle extending therefrom and being adapted to receive a second production tubing; simultaneously lowering the first and second production tubings into the main well bore, aligning a diverter and the first production tubing adjacent the at least one lateral well bore; and simultaneously lowering the first and second production tubings until they each engage the polished bore receptacles on the first and second packers, respectively. Another feature of this aspect of the invention is that the first and second production tubings are connected to a dual packer, one of the first and second production tubings is connected to the diverter, and the method further includes simultaneously lowering the dual packer into the well casing with the first and second production tubings and the diverter. Another feature of this aspect of the invention is that the method may further include: connecting a work string to the dual packer; using the work string to lower the dual packer, first and second production tubings, and diverter into the main well bore; using the work string to simultaneously push the first and second production tubings into engagement with the polished bore receptacles on the first and second packers, respectively; disconnecting the work string from the dual packer; and retrieving the work string. Another feature of this aspect of the invention is that the method may further include connecting the first production tubing to a third production tubing extending to the earth's surface, and connecting the second production tubing to a fourth production tubing extending to the earth's surface. Another feature of this aspect of the invention is that the method may further include connecting the first and second production tubings to a central production tubing extending to the earth's surface.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1A:
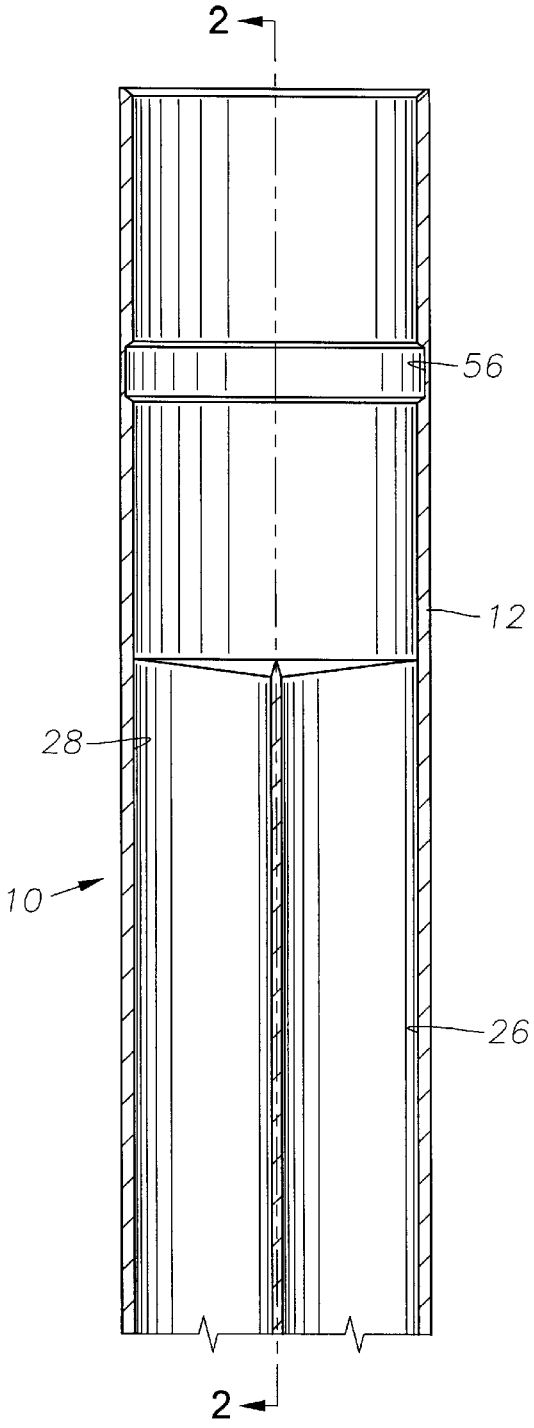
FIGS. 1A–1D illustrate a longitudinal cross-sectional view of the downhole tool of the present invention.
Figure 1B:
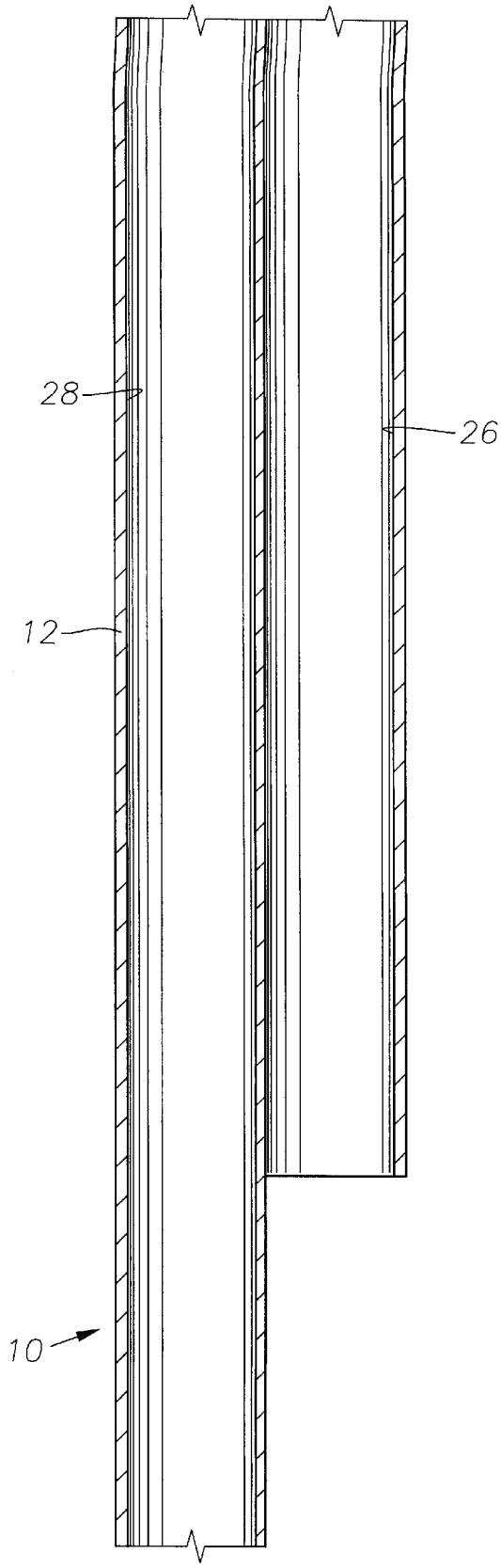
Figure 1C:
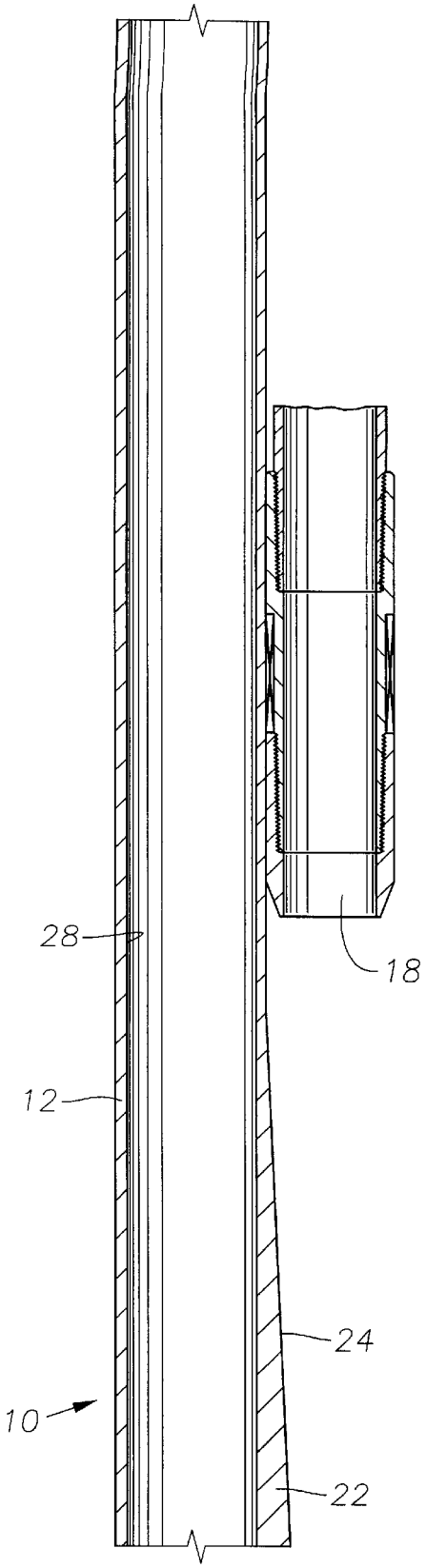
Figure 1D:
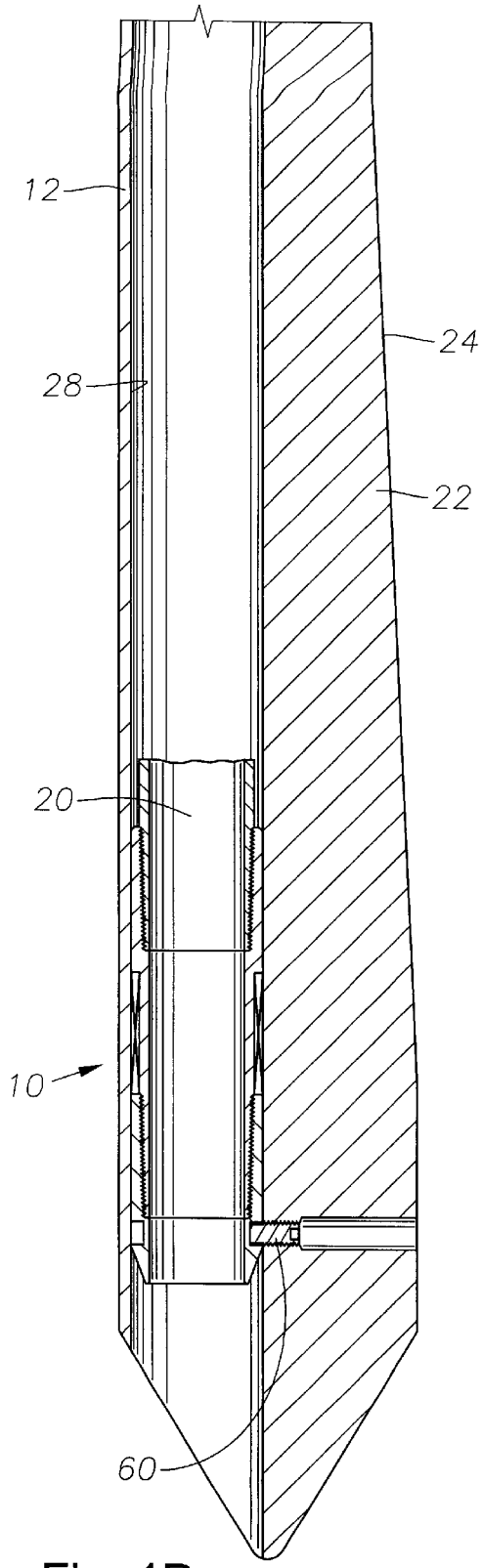
Figure 2:
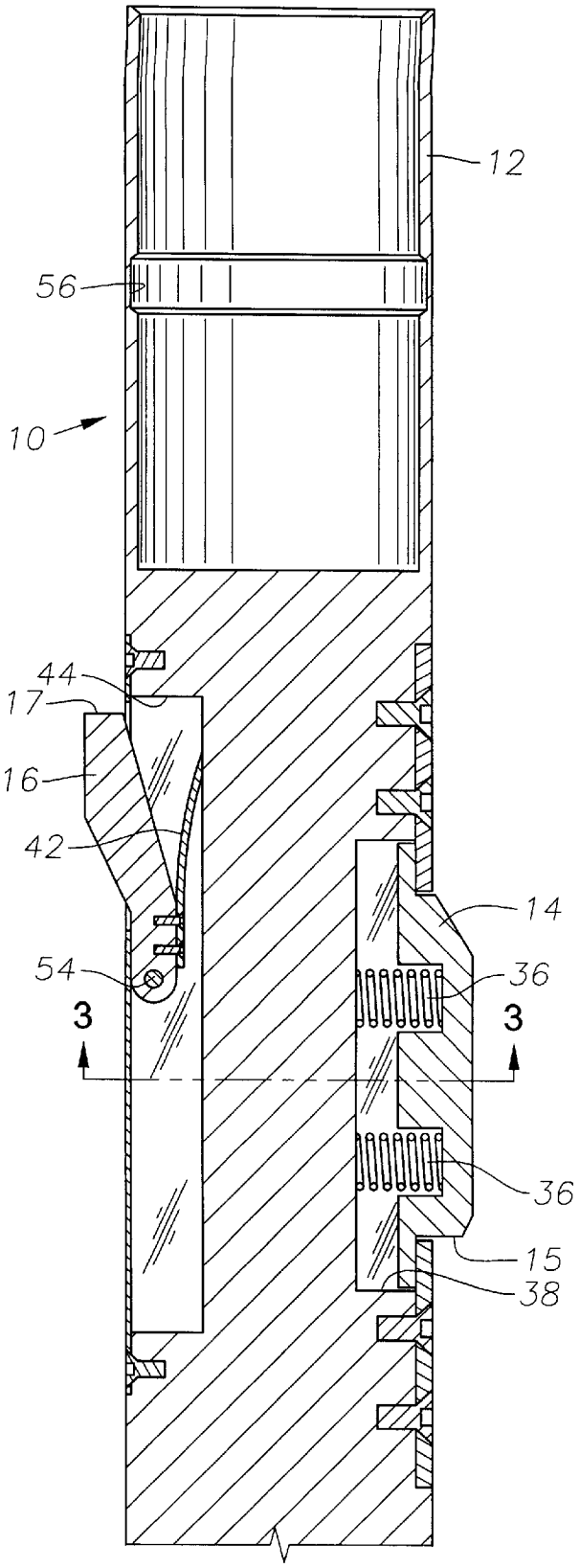
FIG. 2 is a cross-sectional view taken along line 2—2 of FIG. 1.
Figure 3:
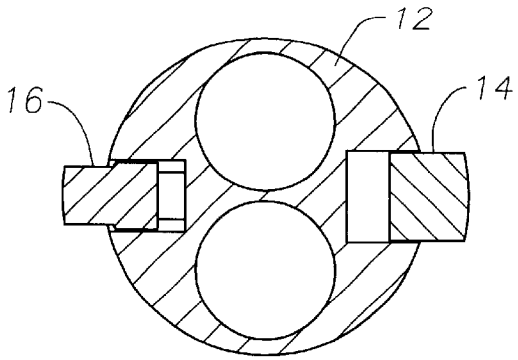
FIG. 3 is a cross-sectional view taken along line 3—3 of FIG. 2.
Figure 4:
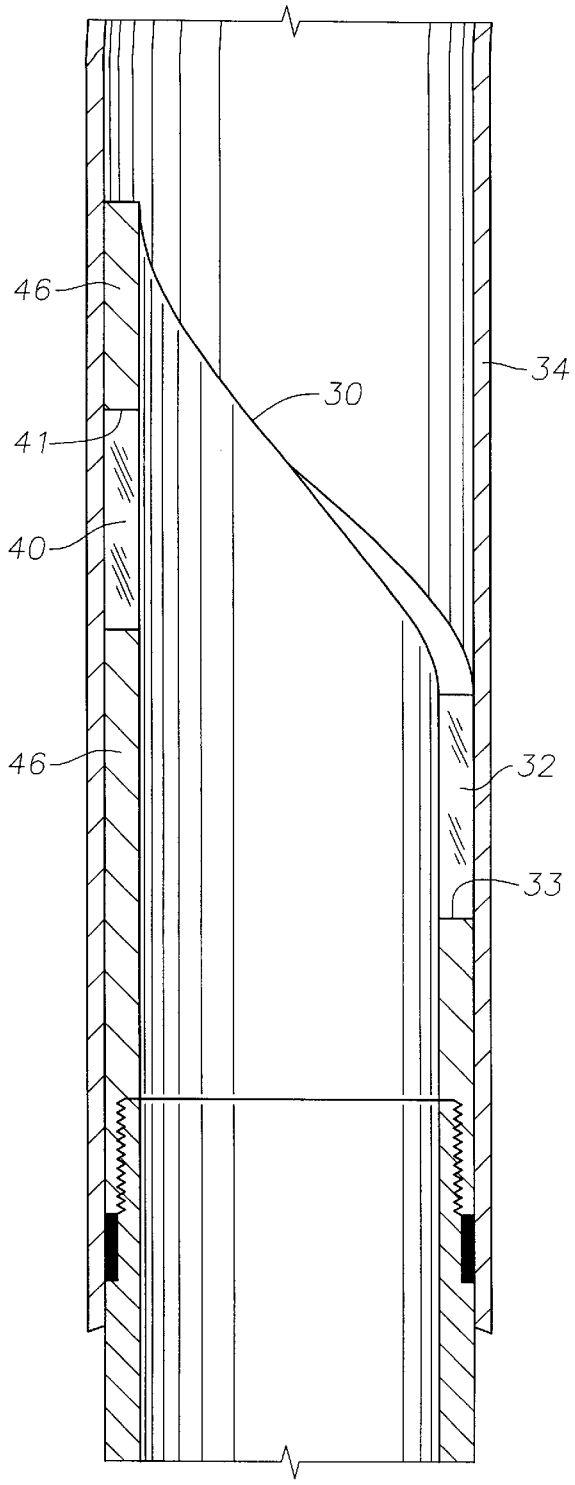
FIG. 4 is a longitudinal cross-sectional view illustrating a section of well casing in which the tool shown in FIGS. 1–3 is engageable.
Figure 5A:
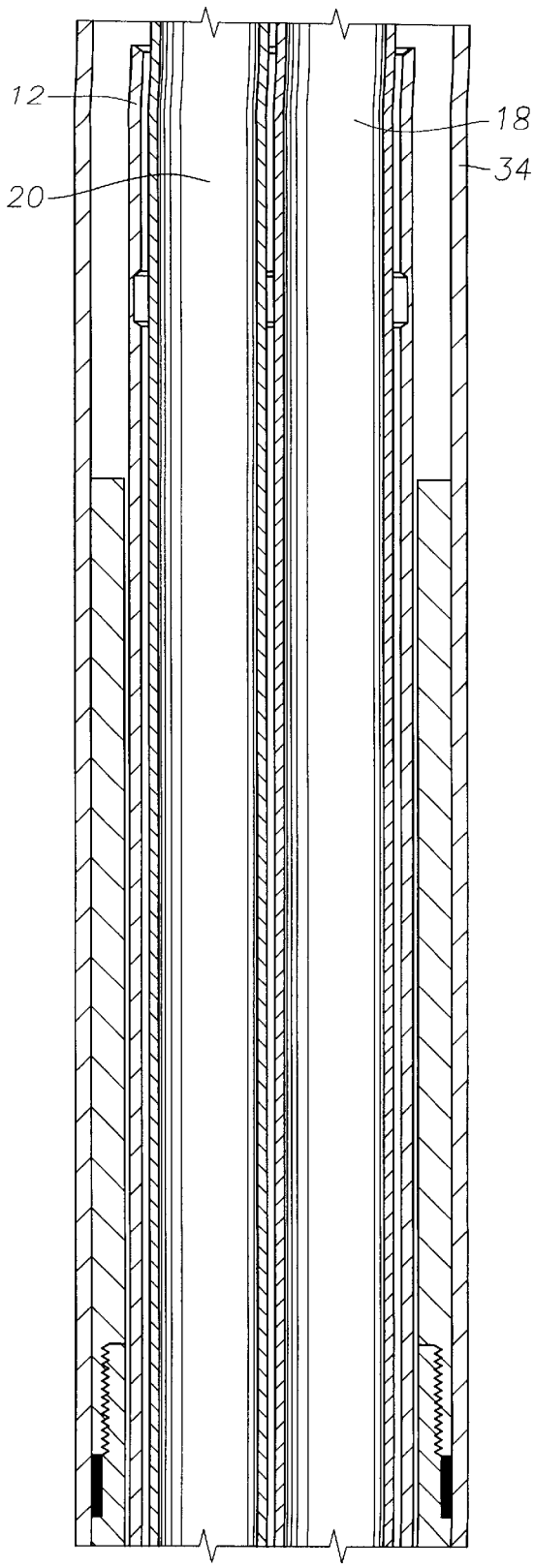
FIGS. 5A–5E illustrate a longitudinal cross-sectional view of the downhole tool shown in FIGS. 1A–1D located within the well casing.
Figure 5B:
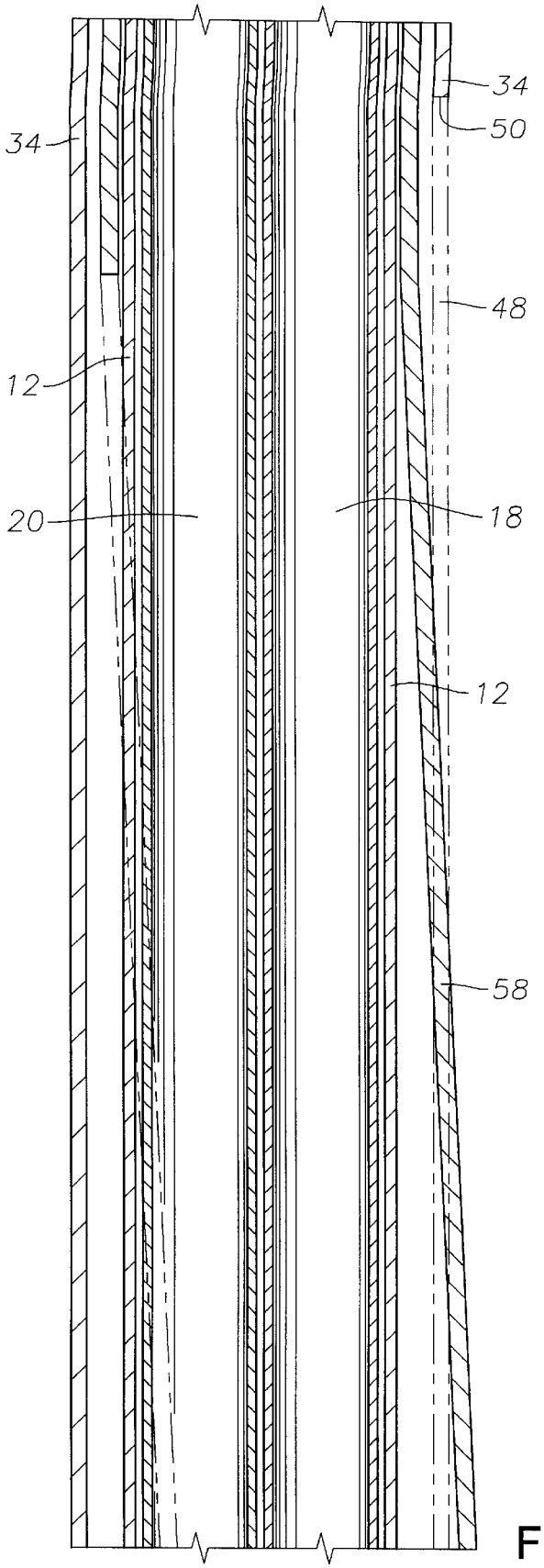
Figure 5C:
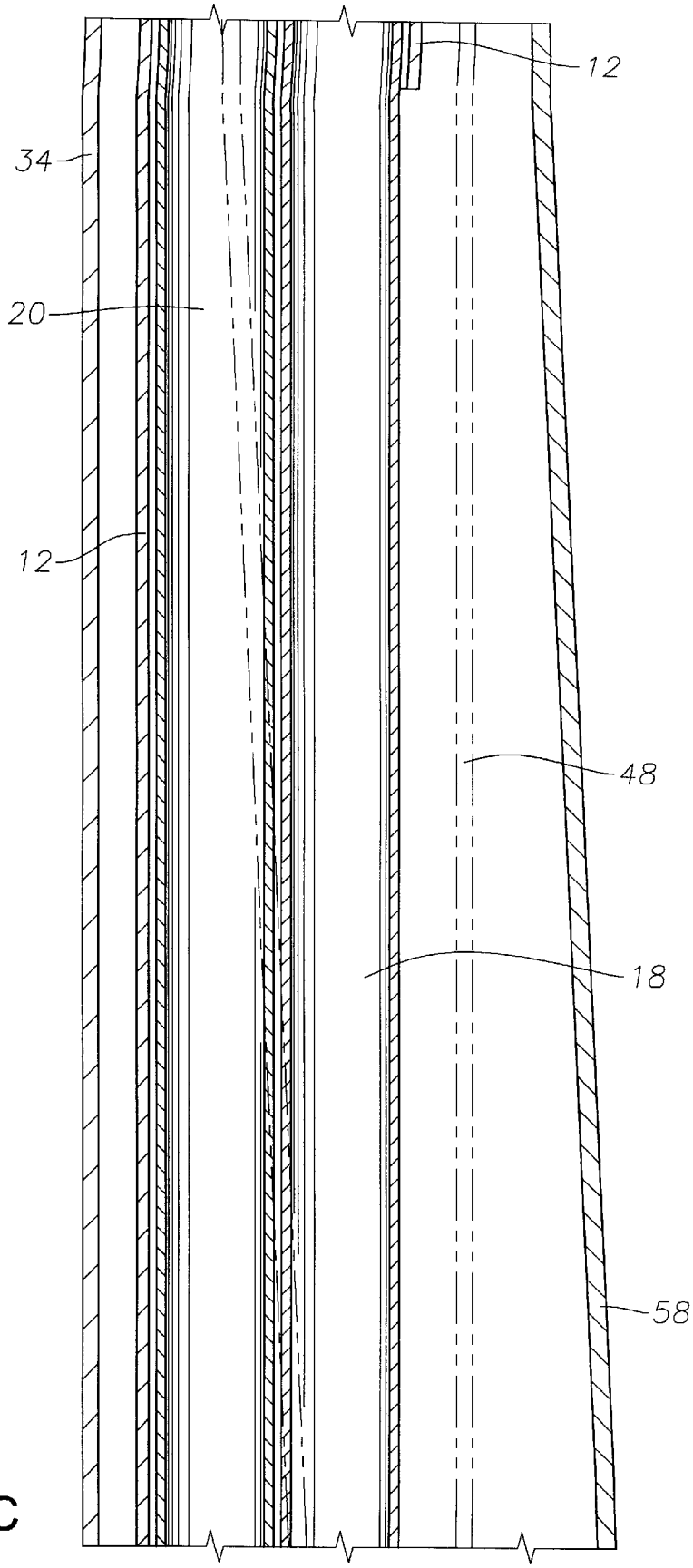
Figure 5D:
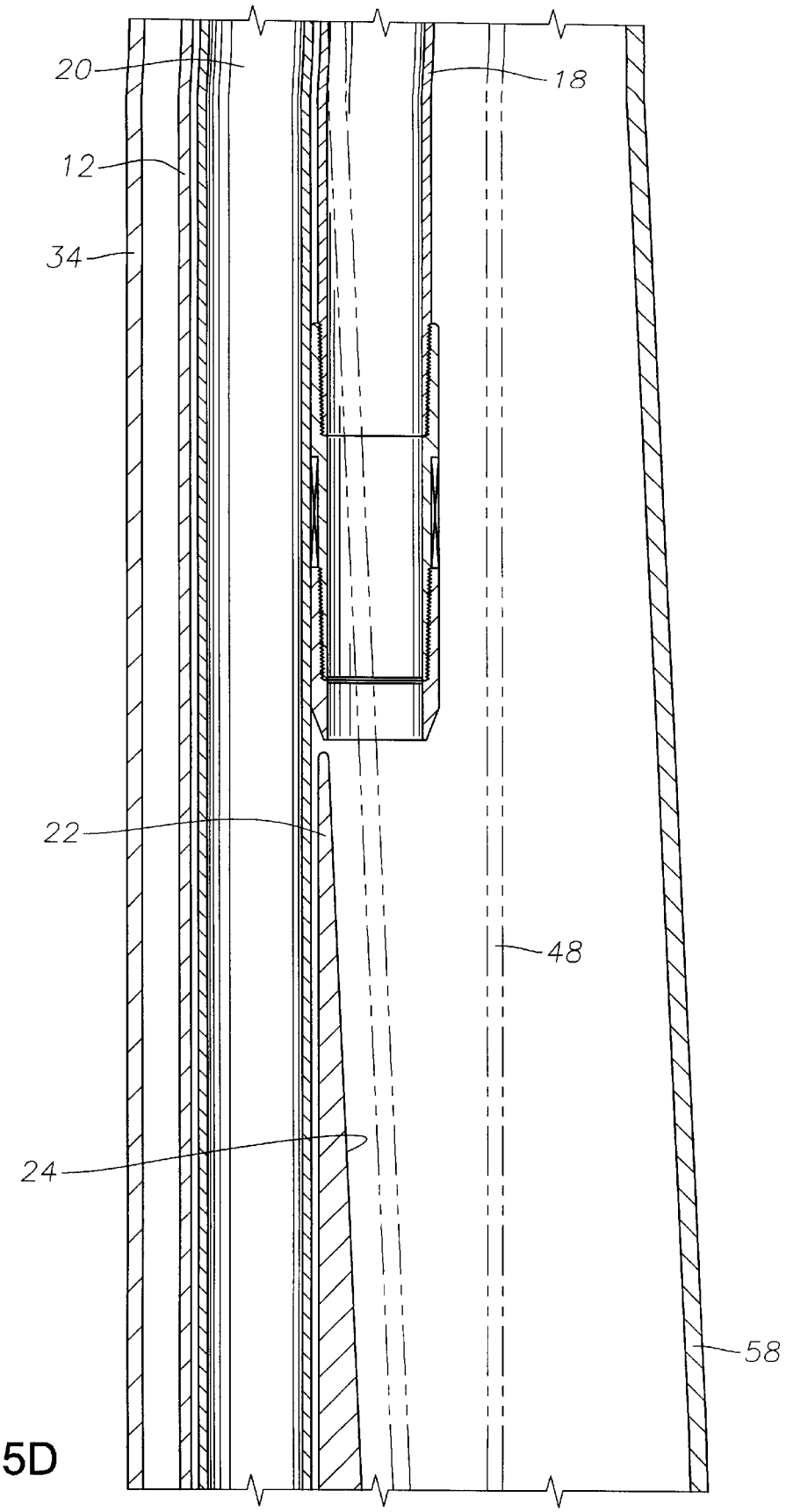

Referring to the drawings in detail, wherein like numerals denote identical elements throughout the several views, it can be seen with reference to FIGS. 1–3 that, in a broad aspect, the downhole tool 10 of the present invention may broadly include a body member 12, an orienting key 14 (see, e.g., FIGS. 2 and 3), a locking key 16 (see, e.g., FIGS. 2 and 3), a first production tubing 18 (see, e.g., FIGS. 1C and 5A) and a second production tubing 20 (see, e.g., FIGS. 1D and 5A). As best shown in FIGS. 1C and 1D, the body member 12 further includes a diverter member 22 extending therefrom and having a diverter surface 24. The body member 12 further includes a first longitudinal bore 26 and a second longitudinal bore 28 extending therethrough. The second longitudinal bore 28 also extends through the diverter member 22. The lower end of the diverter member 22 may be cone-shaped. With reference to FIGS. 2 and 3, the orienting key 14 is movably secured to the body member 12, and engageable with an orienting profile 30 and an alignment slot 32, both of which are disposed in a well casing 34 (see FIG. 4). Referring to FIGS. 2–4, the orienting key 14 is biased outwardly (e.g., by one or more springs 36) and may be disposed for radial movement within a first recess 38 in the body member 12. The locking key 16 is movably secured to the body member 12, and engageable with a locking slot 40 in the well casing 34 (FIG. 4). As shown in FIGS. 2 and 3, the locking key 16 is biased outwardly (e.g., by a spring 42, which may be secured to the locking key 16) and may be hingedly disposed in a second recess 44 in the body member 12. With reference to FIG. 4, it is noted that the profile 30, the orienting slot 32, and the locking slot 40 may be formed as part of the well casing 34, or as a separate component (sometimes referred to as a "muleshoe" or a "discriminator" 46), which is attached to the well casing 34.

Figure 6:
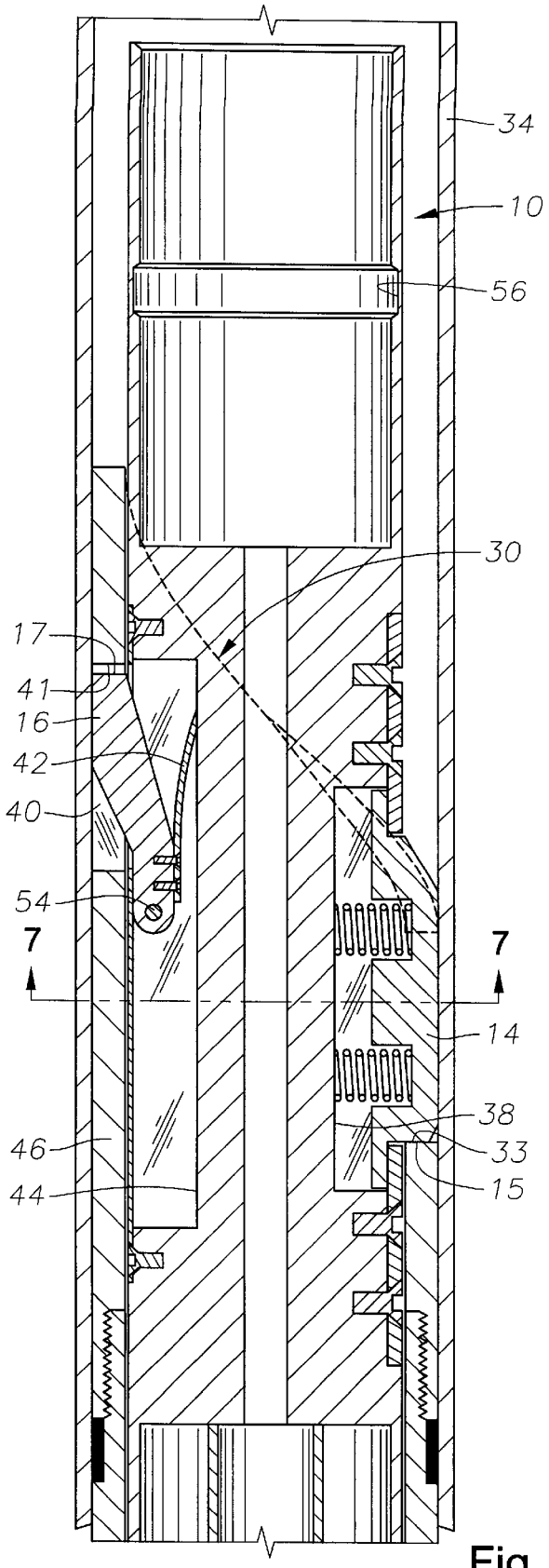
FIG. 6 is basically a combination of FIGS. 2 and 4, and illustrates the tool engaged with the well casing.
Figure 7:
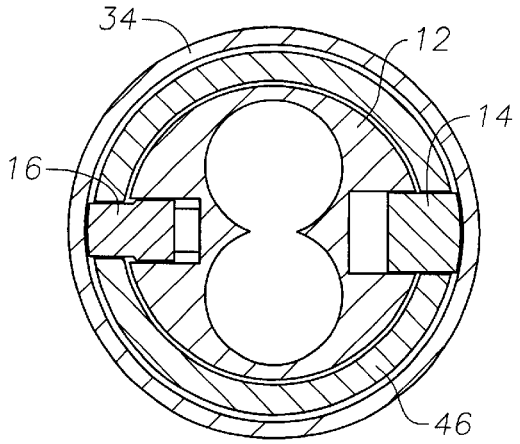
FIG. 7 is a cross-sectional view taken along line 7—7 of FIG. 6.

With reference now to FIG. 6, which is basically a combination of FIGS. 2 and 4, the tool 10 of the present invention is shown engaged with the well casing 34. The manner in which the tool 10 is moved into this position will now be explained.

As the tool 10 (see FIG. 2) is being lowered into the well casing 34 (see the top of FIG. 4), a lower edge 15 of the orienting key 14 (FIG. 2) will come into contact with the profile 30 (FIG. 4). Further downward movement of the tool 10 will cause the key 14 to move along the profile 30 and into engagement with the alignment slot 32, thereby rotating the tool 10 and the attached diverter surface 24—recall FIGS. 1C and 1D—into proper alignment with a lateral well bore window 48, as shown in FIGS. 5B–5E; the lateral well bore window 48 has an upper edge 50 (see FIG. 5B) and a lower edge 52 (see FIG. 5E). Referring back to FIGS. 2 and 4, as the orienting key 14 travels along the profile 30, the locking key 16 will move inside the discriminator 46, which will depress the locking key 16 into the recess 44. When the orienting key 14 moves into the alignment slot 32, the locking key 16 will be longitudinally aligned with the locking slot 40. And when the lower edge 15 of the orienting key 14 bottoms out on a lower edge 33 of the alignment slot 32 (FIG. 4), the locking key 16 will be shifted into the locking slot 40 under force of the spring 42. Upward movement of the tool 10 will then be restrained by contact of an upper edge 17 of the locking key 16 with an upper edge 41 of the locking slot 40, as shown in FIG. 6. If it is desired to remove the tool 10 from the well casing 34, the tool 10 may be disengaged by imparting an upward force to the tool 10 of sufficient magnitude to shear whatever mechanism by which the locking key 16 is movably secured to the body member 12 (e.g., a hinge pin 54). A customary well tool (not shown) may be engaged with a locking profile 56 in the tool 10 (see, e.g., the top of FIG. 2) and used to impart the upward shearing force to the tool 10.

Figure 5E:
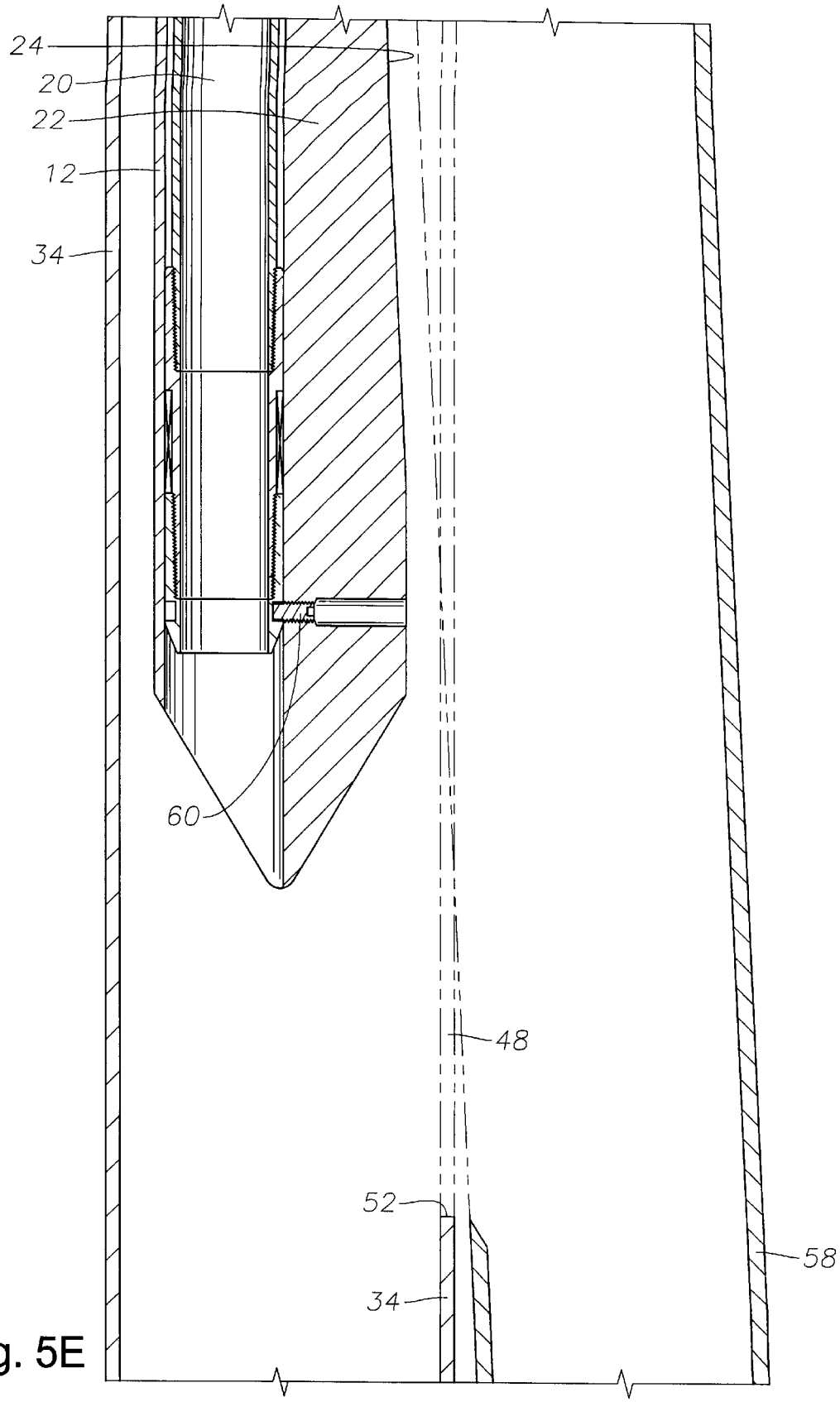

Referring now to FIGS. 5A–5E, which illustrate the tool 10 after it has been oriented and locked in place, it can be seen that the diverter member 22 has been rotated such that the diverter surface 24 is properly aligned with the lateral well bore window 48, and is properly positioned to guide the first production tubing 18 into a lateral well casing 58 extending from the main casing 34. This can also be seen with reference to FIG. 8. Up to this point, one of the first and second production tubings 18 and 20 have been releasably secured to the body member 12. For example, as shown in FIG. 1D and 5E, the second production tubing 20 is releasably secured to the body member 12, as at the lower end of the diverter member 22 (e.g., by any type of fastener 60, including but not limited to screw, shear pin, bolt, etc.). The first and second production tubings 18 and 20 are connected so as to prevent relative longitudinal movement therebetween, such as by being directly connected together, or by both of them being connected to another well device, such as a packer. As such, by directly securing one of the production tubings 18 and 20 to the body member 12, the other one is indirectly secured to the body member 12.

Figure 8:
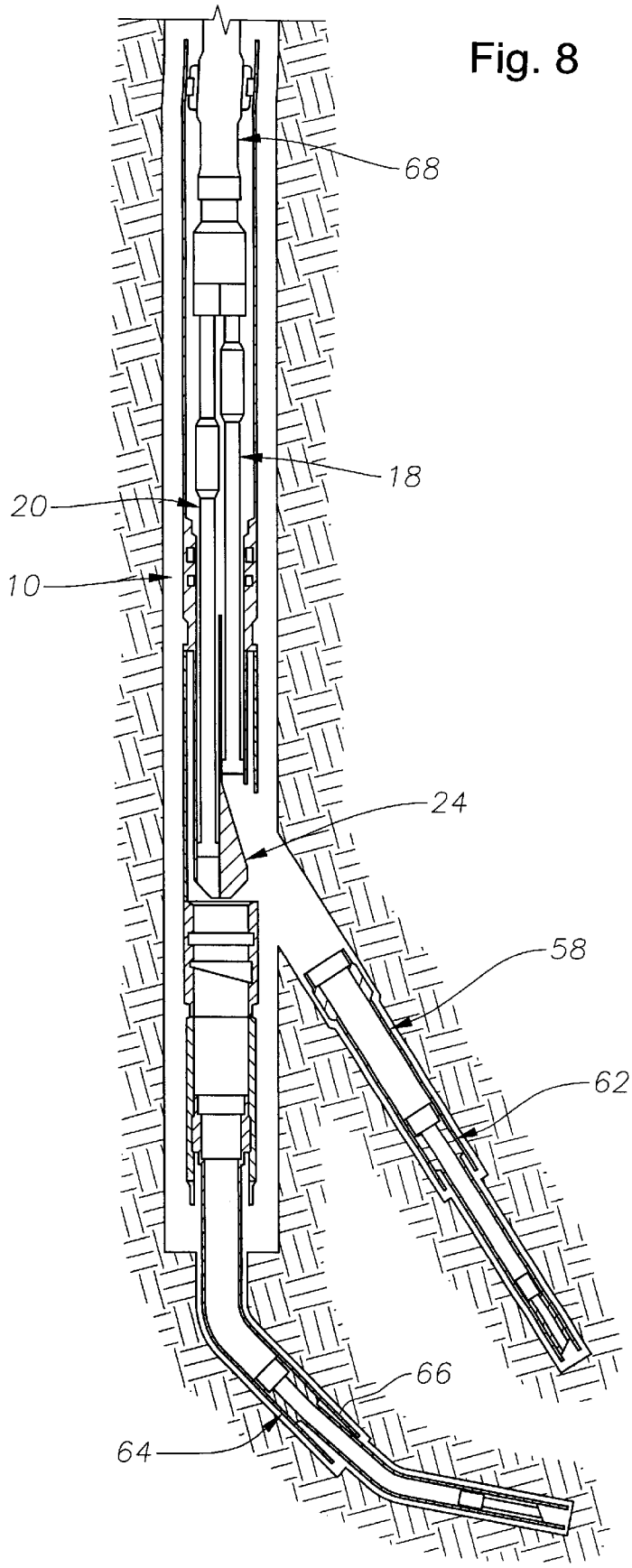
FIG. 8 is an elevational view showing the tool of the present invention oriented and locked within the main casing with the first and second production tubings ready to be pushed into the their respective well bores for well completion.

The next step is to push or lower the first and second production strings 18 and 20 into their respective completed positions. This is done by imparting a downward force to the first and second production tubings 18 and 20 of sufficient magnitude to shear the fastener 60 so that the production tubings 18 and 20 may be pushed into place. With reference to FIG. 8, the first production tubing 18 will be guided along the diverter surface 24 into the lateral well casing 58 and into engagement with a polished bore receptacle extending from a first packer 62 that has previously been set in place and positioned to receive the first production tubing 18. The second production tubing 20 will be pushed downwardly and into engagement with another polished bore receptacle extending from a second packer 64, which may be positioned within the main well bore or in another lateral well bore 66. It is further noted that the first and second production tubings 18 and 20 may extend to the earth's surface (not shown), or they may terminate in a relatively larger, or central, production tubing 68, as shown in FIG. 8, which extends to the earth's surface (not shown).

Alternative embodiments and additional features of the present invention will now be described in connection with FIGS. 9 and 10.

Figure 9:
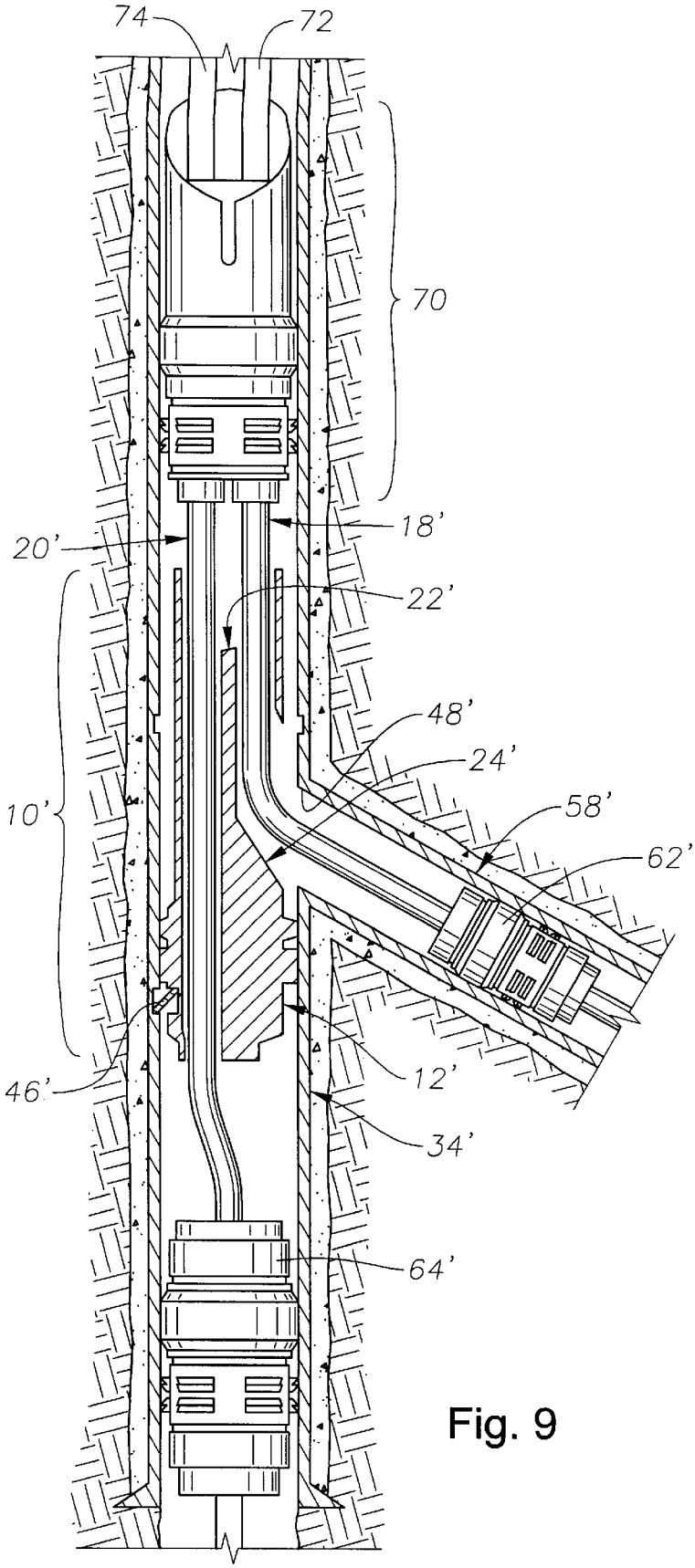
FIG. 9 is an elevational view of an alternative embodiment of the present invention.
Figure 10:
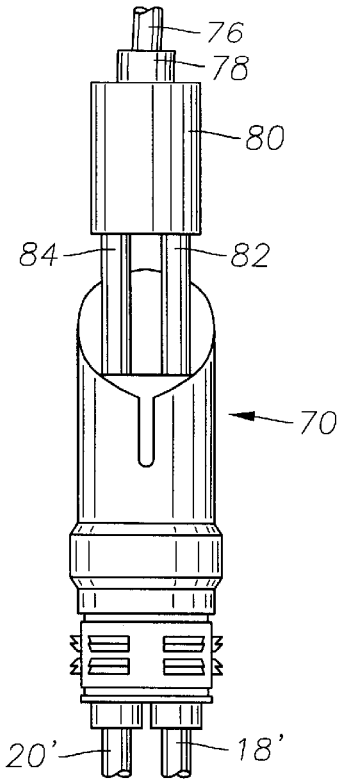
FIG. 10 an elevational view of another embodiment of the present invention.

With reference to FIG. 9, an alternative embodiment 10' of the tool of the present invention is shown locked within a main well casing 34' adjacent a lateral well casing 58'. It is noted that the tool 10' shown here is configured basically upside-down relative to the tool 10 discussed above and illustrated in FIGS. 1–3. Instead of the diverter member 22' extending downwardly, it extends upwardly from the body member 12'. Also, the discriminator 46' is attached to the casing 34' at a position below the lateral well casing 58' instead of above it. The tools 10 and 10' are similar, however, in all other basic respects (e.g., two longitudinal bores therethrough, two production tubings 18' and 20' disposed through those bores, diverter surface 24' aligned with lateral well bore window 48', etc.). The manner in which the various components of the completion shown in FIG. 9 are installed will now be discussed.

After the casings 34' and 58' have been cemented in place, first and second packers 62' and 64', each having polished bore receptacles, are set in place in the lateral well casing 58' and main well casing 34', respectively. An assembly consisting of a dual packer 70, the tool 10' and the production tubings 18' and 20' is connected to a work string (not shown) and lowered into the well. Both production tubings 18' and 20' are connected to the dual packer 70, and one of the production tubings 18' or 20' is connected to the tool 10', so that the tool 10' is "hanging" below the dual packer 70 from one of the production tubings 18' or 20'. This assembly is lowered into the well casing 34' and set in place therein in the manner as explained above with regard to the tool 10 and FIGS. 1–4 (i.e., the locking and orienting keys cooperate with the discriminator 46' to orient and align the diverter surface 24' with the lateral well bore window 48' and lock the tool 10' to the casing 34'). Once the assembly is set in place, a weight may be placed down on the work string (not shown) to simultaneously push the production tubings 18' and 20' into engagement with their respective polished bore receptacles. The work string (not shown) is then remotely disconnected from the dual packer 70 and removed to the earth's surface (not shown). Next, dual production tubings 72 and 74 may be lowered into engagement with the dual packer 70 so as to establish fluid communication with the production tubings 18' and 20', respectively. Alternatively, instead of running the dual production tubings 72 and 74 all the way from the earth's surface (not shown), a single production tubing 76, shown in FIG. 10, may be used to establish fluid communication to the earth's surface. In this alternative embodiment, a swivel 78 is connected between the tubing 76 and a wireline reentry tool 80, which has two relatively short sections of production tubing 82 and 84 extending therefrom for engagement with the dual packer 70 and the production tubings 18' and 20'.

From the above, it should now be apparent that the present invention results in an improved and more efficient approach to completing dual string wells where at least one of the production strings is completed in a lateral well bore. By employing the present invention, significant cost savings may be realized by simultaneously running dual production strings into the well, in one trip, instead of making two trips into the well, one for each production string.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. A downhole well tool for use within a well casing having a locking slot, an orienting profile, an alignment slot, and a lateral well bore window, the tool comprising:

a body member having a first and a second longitudinal bore extending therethrough, a diverter member extending therefrom and having a diverter surface, the second longitudinal bore extending through the diverter member;

an outwardly-biased orienting key movably secured to the body member and engageable with the orienting profile and the alignment slot;

at least one orienting spring disposed to outwardly bias the orienting key;

an outwardly-biased locking key movably secured to the body member and engageable with the locking slot, the diverter surface being aligned with the lateral well bore window when the orienting key is engaged with the alignment slot and the locking key is engaged with the locking slot;

at least one locking spring disposed to outwardly bias the locking key;

a first production tubing extending through the first longitudinal bore and aligned with the diverter surface; and a second production tubing extending through the second longitudinal bore, one of the first and second production tubings being releasably secured to the body member.

2. The downhole well tool of claim 1, wherein the second production tubing is releasably secured to the diverter member.

3. The downhole well tool of claim 1, wherein a lower end of the diverter member is cone-shaped.

4. The downhole well tool of claim 1, wherein the orienting and locking keys are outwardly biased by at least one spring.

5. The downhole well tool of claim 1, wherein the orienting key is disposed for radial movement within a first recess in the body member.

6. The downhole well tool of claim 1, wherein the locking key is disposed for movement within a second recess in the body member.

7. The downhole well tool of claim 6, wherein the locking key is hingedly attached to the body member.

8. The downhole well tool of claim 1, wherein the locking key is shearably disconnectable from the body member.

9. The downhole well tool of claim 1, wherein the body member includes a locking profile remotely engageable with a well tool for disengaging the well tool from the casing.

10. The downhole well tool of claim 1, wherein the diverter member extends downwardly from the body member, and the locking slot, orienting profile and alignment slot are disposed in the well casing above the lateral well bore window.

11. A downhole well tool for use within a well casing having a lateral well bore window, the tool comprising:

discriminator connected within the well casing and having a locking slot, an orienting profile, and an alignment slot;

a body member having a first and a second longitudinal bore extending therethrough, a diverter member extending therefrom and having a diverter surface, the second longitudinal bore extending through the diverter member;

an outwardly-biased orienting key movably secured to the body member and engageable with the orienting profile and the alignment slot;

at least one orienting spring disposed to outwardly bias the orienting key;

an outwardly-biased locking key movably secured to the body member and engageable with the locking slot, the diverter surface being aligned with the lateral well bore window when the orienting key is engaged with the alignment slot and the locking key is engaged with the locking slot;

at least one locking spring disposed to outwardly bias the locking key;

a first production tubing extending through the first longitudinal bore and aligned with the diverter surface; and a second production tubing extending through the second longitudinal bore, one of the first and second production tubings being releasably secured to the body member.

12. The downhole well tool of claim 11, wherein the second production tubing is releasably secured to the diverter member.

13. The downhole well tool of claim 11, wherein a lower end of the diverter member is cone-shaped.

14. The downhole well tool of claim 11, wherein the orienting and locking keys are outwardly biased by at least one spring.

15. The downhole well tool of claim 11, wherein the orienting key is disposed for radial movement within a first recess in the body member.

16. The downhole well tool of claim 11, wherein the locking key is disposed for movement within a second recess in the body member.

17. The downhole well tool of claim 16, wherein the locking key is hingedly attached to the body member.

18. The downhole well tool of claim 11, wherein the locking key is shearably disconnectable from the body member.

19. The downhole well tool of claim 11, wherein the body member includes a locking profile remotely engageable with a well tool for disengaging the well tool from the casing.

20. The downhole well tool of claim 11, wherein the diverter member extends downwardly from the body member, and the discriminator is connected to the well casing above the lateral well bore window.

21. A method of completing a well having a main well bore and at least one lateral well bore, the method comprising:

positioning a completion assembly in the main well bore, the completion assembly comprising a body member having a first and a second longitudinal bore extending therethrough, at least a first and a second production tubing, a tubing diverter integrally connected to the body member, an orienting key engageable with an orienting profile in a casing disposed in the main well bore and outwardly biased by at least one orienting spring, and a locking key engageable with a locking slot in the casing and outwardly biased by at least one locking spring; and simultaneously lowering the first and second production tubings, guided by the tubing diverter, the first production tubing being lowered into the at least one lateral well bore, and the second production tubing being lowered into one of the main well bore and another lateral well bore.

22. A method of completing a well having a main well bore and at least one lateral well bore, the method comprising:

setting a first packer in the at least one lateral well bore, the first packer having a polished bore receptacle extending therefrom and being adapted to receive a first production tubing;

setting a second packer in one of the main well bore and another lateral well bore, the second packer having a polished bore receptacle extending therefrom and being adapted to receive a second production tubing;

simultaneously lowering the first and second production tubings into the main well bore, aligning a diverter and the first production tubing adjacent the at least one lateral well bore; and simultaneously lowering the first and second production tubings until they each engage the polished bore receptacles on the first and second packers, respectively.

23. The method of claim 22, wherein the first and second production tubings are connected to a dual packer, one of the first and second production tubings is connected to the diverter, and the method further includes simultaneously lowering the dual packer into the well casing with the first and second production tubings and the diverter.

24. The method of claim 23, further including:

connecting a work string to the dual packer;

using the work string to lower the dual packer, first and second production tubings, and diverter into the main well bore;

using the work string to simultaneously push the first and second production tubings into engagement with the polished bore receptacles on the first and second packers, respectively;

disconnecting the work string from the dual packer; and retrieving the work string.

25. The method of claim 22, further including connecting the first production tubing to a third production tubing extending to the earth's surface, and connecting the second production tubing to a fourth production tubing extending to the earth's surface.

26. The method of claim 22, further including connecting the first and second production tubings to a central production tubing extending to the earth's surface.

* * * * *